United States Patent [19]

Hirsimäki

[11] Patent Number: 5,032,228

[45] Date of Patent: Jul. 16, 1991

[54] METHOD OF AND AN ARRANGEMENT FOR SUPPORTING THE FRAME OF A PAPER MACHINE

[75] Inventor: Laijo Hirsimäki, Tampere, Finland

[73] Assignee: Oy Tampella AB, Tampere, Finland

[21] Appl. No.: 496,877

[22] Filed: Mar. 21, 1990

[30] Foreign Application Priority Data

Mar. 31, 1989 [FI] Finland ..... 891564

[51] Int. Cl.[5] ..... D21F 7/00; D21F 1/24

[52] U.S. Cl. ..... 162/199; 162/200; 162/273; 162/274

[58] Field of Search ..... 162/199, 200, 272, 273, 162/274, 358

[56] References Cited

U.S. PATENT DOCUMENTS

| | | | |
|---|---|---|---|
| 3,352,747 | 10/1967 | Lithgo et al. | 162/199 |
| 3,547,776 | 12/1970 | Curtis | 162/199 |
| 3,989,587 | 10/1976 | Grossmann | 162/200 |
| 4,140,575 | 2/1979 | Wenzl | 162/273 |
| 4,481,078 | 10/1984 | Niemi | 162/199 |
| 4,560,441 | 12/1985 | Kraft et al. | 162/273 |
| 4,875,975 | 10/1989 | Schiel | 162/200 |

*Primary Examiner*—Karen M. Hastings

*Attorney, Agent, or Firm*—Ladas & Parry

[57] ABSTRACT

The invention relates to a method and an arrangement for supporting the frame of a paper machine or the like. In the method, the frame is supported at a point below it for the time the wire or felt is being changed by means of a separate support member (11) on a normal frame supporting structure (1), whereby it is not necessary to strengthen or support the other structures during the change. The arrangement comprises a support member (11) provided under the frame and comprising a support (14) arranged to be displaced so as to rest on a support element (15) attached to the supporting structure (1) to support the frame. The support (14) supports the frame on its normal supporting structure (1) while the lower vertical spacers (9) of the frame are out of place.

8 Claims, 1 Drawing Sheet

METHOD OF AND AN ARRANGEMENT FOR SUPPORTING THE FRAME OF A PAPER MACHINE

The invention relates to a method of removing spacers provided in vertical beams on one longitudinal side of the frame of a paper machine, and supporting the frame while changing a wire or felt, wherein horizontal beams in the frame are lifted at the ends close to the spacers and correspondingly lowered after the spacers have been returned in place and the horizontal beams of the frame are supported into a substantially horizontal position for passing the wire into the machine through openings left by the removed spacers.

The invention is also concerned with an arrangement for removing spacers provided in vertical beams on one longitudinal side of the frame of a paper machine, and supporting the frame while changing a wire or felt, comprising means for lifting and lowering horizontal beams in the frame at the ends close to said spacers, and means for supporting the horizontal beams of the frame in a substantially horizontal position to enable the removal of the spacers and the passing of the wire into the machine through openings left by the spacers.

The wire and press sections used in paper machines today are usually cantilevered, whereby the vertical beams on one side of the frame comprise separate removable spacers, a wire or felt being passed into the machine in one piece through an opening left by the removed spacers. As used in the present patent application, the term 'paper machine' refers to a paper or board machine or any similar device producing a weblike product from a fibre suspension. To remove the spacers, the frame has to be lifted from the side of the spacers and, correspondingly, to be supported so as to form an opening at the removed spacers for the passage of the wire or felt. The frame is usually supported by means of various cantilever beams and lifting cylinders on the side of the spacers or on the opposite side. The floor of the machinery hall is in most cases designed for normal load, whereby the weight of the machine is not supported by the floor itself but by special supporting walls and supporting structures. Therefore it is necessary to separately support the floor points loaded by the cantilever beam-lifting cylinder arrangement for the time the wire or felt is being lifted. This, in turn, increases the construction cost, or when temporary floor support arrangements are used causes extra work.

It is also possible to use supporting drag-bars tightened on the beams on the opposite side of the frame with respect to the spacers to keep the frame open after the removal of the spacers. To remove the spacers, the frame thereby has to be lifted by means of separate jacks which are then removed for the change of the wire or felt. A drawback of this solution is that the drag-bars constantly expose the frame to an extra strain. A further drawback is that separate removable jacks or the like have to be used for lifting the frame sufficiently both for the removal and the installation of the spacers. This involves extra work and the frame and the structures are strained by the constant extra pressing force acting on one side of the frame.

U.S. Pat. No. 4,560,441 discloses a solution in which the frame is supported by a cantilever-lifting cylinder arrangement on a separate supporting structure positioned on the opposite side of the machine with respect to the spacers. This additional supporting structure separately constructed in the machine causes extra costs and takes space.

A common drawback of all prior art support solutions is that structural parts not originally designed for the support of the frame or especially designed for the purpose are put under extra strain. This complicates the work and causes extra costs.

The object of the invention is to provide a method and an arrangement for supporting the frame, by means of which the above-described difficulties are avoided and which are simple and easy to effect. This is achieved by means of the method of the invention in such a manner that the lowest horizontal beam of the frame is supported during the removal of the spacers and the passing of the wire or felt on a normal frame supporting structure by means of a support member provided therein.

The basic idea of the invention is that the frame is supported at a point below the lower spacer on the supporting structure on the side of said spacer, whereby the load caused by the frame acts all the time on the supporting structure even when the wire or felt is being passed under the frame through the formed opening. After the spacer has again been mounted in place, support is no longer needed, and the support member is displaced aside and the wire or felt can be spread in place.

The arrangement of the invention is characterized in that the supporting means comprise at least one support member attached to the frame and arranged to support the lowest horizontal beam of the frame on a normal frame supporting structure.

Essential in the arrangement of the invention is that a separate support member is provided below the frame. In a determined position, this member extends up to a support element attached to the supporting structure on the side of the spacer so that when the support member is displaced above the support element, it supports the frame of the machine after the spacers have been removed. Thereby the weight of the frame portion on the side of the spacers remains to be supported by the normal frame supporting structure after .the spacers have been removed and the wire or felt is passed through the openings left by the spacers, whereafter the spacers are returned in place and the support is displaced aside from above the support element so that the wire or felt can be passed into its proper position over the entire width of the machine.

BRIEF DESCRIPTION OF THE DRAWINGS

The invention will be described in greater detail in the attached drawings, wherein

FIG. 1 is a cross-sectional view of the frame of a paper or board machine resting on supporting structures 1 and 2. In this particular case, the supporting structures 1 and 2 form part of the wall structures or the like provided under the machine. The frame of the machine comprises horizontal beams 3 and 4, between which vertical beams 5 and 6 are provided. Furthermore, the beams 3 and 4 project beyond the frame on one side of the machine, a vertical beam 7 being provided between them. A stiffening brace 8 is further provided between the vertical beams 6 and 7 to stiffen the square formed by the ends of the beams 3 and 4 and the vertical beams 6 and 7. Removable spacers 9 and 10 are provided between the supporting structure 1 and the horizontal beam 3 and within the vertical beam 5 so as to enable the passing of a wire or felt into the machine. A support member 11 is attached to the horizontal beam 3 below it. The support member comprises a support beam 12 made oblique in accordance with the load, and a support 14 attached to the support beam pivotally about a vertical axis 13. A support element 15 is attached to the supporting structure 1. The support 14 is arranged to be pivoted above the support element 15 so as to rest on its upper surface.

Figure 1:
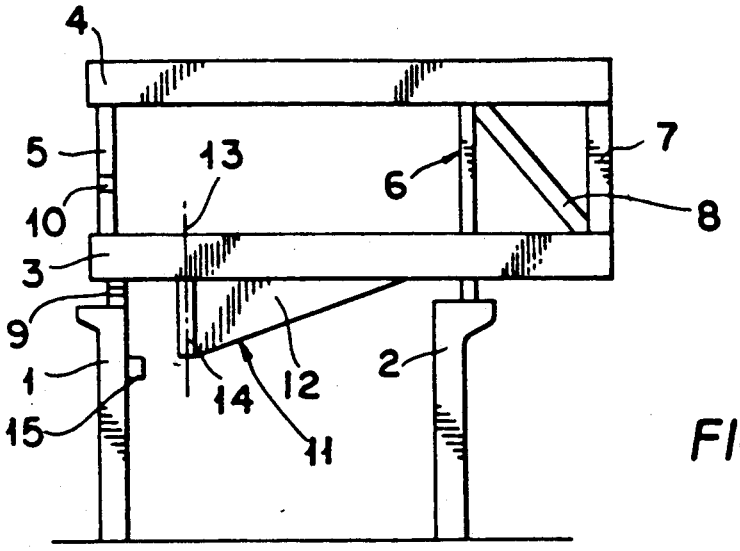
FIG. 1 shows an arrangement of the invention with the spacers mounted in place.

When a new wire of felt is to be passed into the machine, the support 14 is pivoted above the support element 15, whereafter the frame of the machine is lifted upward either by means of a separate lifting means or by a fixed lifting means attached to the support 14 or the support member 11 (will be described below). Thereafter the lower spacer 9 can be removed while the frame of the machine remains resting on the supporting structure 1, thus loading it. The upper spacer 10 can be removed in any manner known per se either by separate lifting means or in some other similar manner. When the lifting means are removed, the frame is supported by the rhombus of the frame so that the weight of the upper portion of the frame will be supported by the supporting structure 2.

The wire or felt is passed in place through the openings left by the spacers 9 and 10, whereby it is positioned in a space formed between the support 14 and the frame. After the wire or felt has been passed through the openings left by the spacers, the spacers are again positioned in place and the frame is lowered on them. Thereafter the support 14 is pivoted aside about the axis 13, so that the wire or felt is able to fall below it and the entire support member 11, and can thus be spread over the whole width of the machine.

Figure 2:
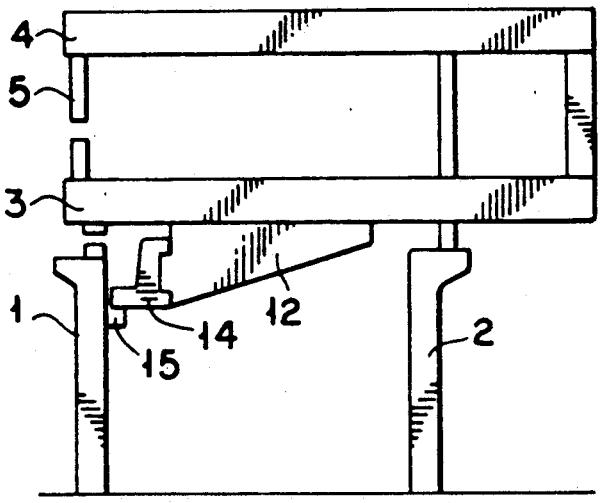
FIG. 2 shows the arrangement of the invention when supported by the support member of the invention.
Figure 3:
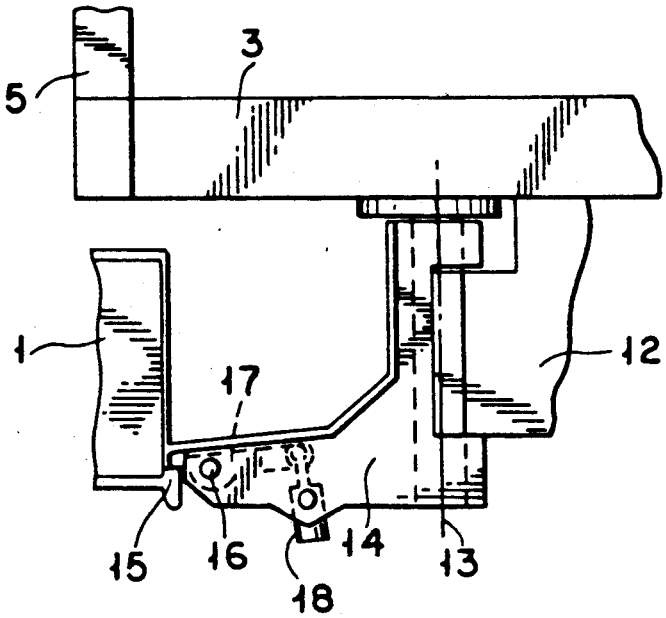
FIG. 3 shows the support solution of FIG. 2 in more detail.

FIG. 3 is a more detailed view of the embodiment of the arrangement of the invention shown in FIGS. 1 and 2, wherein the support 14 is a bracket pivotable about a vertical axis. In this embodiment the body of the support 14 comprises a support arm 17 pivotable about a horizontal axis 16, a lifting cylinder 18 being arranged to act on its one end. The support member 11 is so designed that after the support 14 has been pivoted above the support element 15, the support arm 17 is pivoted by means of the lifting cylinder 18 in such a manner that its end close to the support element 15 is lowered so that the support 14 lifts the frame under the influence of the force of the lifting cylinder 18.

The above specific embodiment of the invention has been described by way of example, and the invention is in no way restricted to it. The support member 11 can be effected in various ways, and the support pivotable about a vertical axis can be replaced with a support sliding transversely relative to the frame of the machine. Furthermore, the frame can be positioned on the support by means of a separate lifting cylinder which lifts the frame so that the support can be displaced above the support element into the supporting position, or the lifting cylinder can be fitted in the supporting structure 1, the support member 11, the support element 15 or the support 14. The invention can be applied to machine frames of different kinds and the upper spacers can be removed in any manner known per se without affecting the invention.

I claim:

1. In a paper-making machine having a frame, a method of removing spacers (9, 10) provided in vertical beams (5) on one longitudinal side of the frame, and supporting the frame while changing a wire or felt, wherein horizontal beams (3, 4) in the frame are lifted at the ends of the beams close to the spacers (9, 10) and correspondingly lowered after the spacers have been returned in place and the horizontal beams (3, 4) of the frame are supported in a substantially horizontal position for passing the wire or felt into the machine through openings left by the removed spacers (9, 10), wherein the lowest horizontal beam (3) of the frame is supported during the removal of the spacers and the passing of the wire or the felt on a frame supporting structure by means of a support member (11) provided therein, and wherein the frame is supported by means of a support beam (12) attached to the lowest horizontal beam (3) and a support (14) displaceable relative to the support beam (12) and arranged to be supported on a support element (15) attached to the frame supporting structure (1).

2. A method according to claim 1, wherein the support member (11) is positioned under the lowest horizontal beam (3) which is to be supported.

3. In a paper-making machine having a frame, an arrangement for removing spacers (9, 10) provided in vertical beams (5) on one longitudinal side of the frame, and supporting the frame while changing a wire or felt, comprising means for lifting and lowering horizontal beams (3, 4) in the frame at the ends of the beams close to said spacers (9, 10) and means for supporting the horizontal beams (3, 4) of the frame in a substantially horizontal position to enable the removal of the spacers (9, 10), and the passing of the wire or felt into the machine through openings left by the spacers, wherein the supporting means comprise at least one support member (11) attached to the frame and arranged to support the lowest horizontal beam (3) of the frame on a frame supporting structure (1), and wherein support member (11) is positioned below the frame and includes a support beam (12) attached to the lowest horizontal beam (3) and a support (14) displaceable relative to said support beam, the supporting structure (1) being provided with a support element (15) below the lowest spacer (9) of the frame and the support (14) being displaceable so as to rest on the support element (15) at least for the time the frame is to be supported.

4. An arrangement according to claim 3, wherein the support member (11) is positioned below the lowest horizontal beam which is to be supported.

5. An arrangement according to claim 4, wherein the support (14) is attached to the support beam (12) so as to pivot relative to said support beam about a vertical axis (13) so that the support member extends over the support element (15) when turned in parallel with the support beam (12).

6. An arrangement according to claim 5, wherein the support (14) and the frame on the longitudinal side of the supporting structure (1) define a space therebetween for the wire or felt.

7. An arrangement according to claim 6, wherein the support member (11) is provided with lifting means (16 to 18) for lifting and lowering the frame relative to the supporting structure (1).

8. An arrangement according to claim 7, wherein said lifting means (16 to 18) are fitted in the support (14) and that the lifting means (16 to 18) comprise a support arm (16) pivotable about a horizontal axis positioned at a distance from the support element (15) relative to the support, and a lifting cylinder (18) arranged to pivot the support arm (16) about the axis (17).

* * * * *